US012017747B2

(12) United States Patent
Tsuchiya

(10) Patent No.: US 12,017,747 B2
(45) Date of Patent: Jun. 25, 2024

(54) MARINE VESSEL MANEUVERING SYSTEM AND MARINE VESSEL

(71) Applicant: YAMAHA HATSUDOKI KABUSHIKI KAISHA, Iwata (JP)

(72) Inventor: Toshiya Tsuchiya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 475 days.

(21) Appl. No.: 17/530,502

(22) Filed: Nov. 19, 2021

(65) Prior Publication Data

US 2022/0169356 A1 Jun. 2, 2022

(30) Foreign Application Priority Data

Dec. 2, 2020 (JP) ..... 2020-200184

(51) Int. Cl.
*B63H 25/42* (2006.01)
*B63H 21/21* (2006.01)
*B63H 25/02* (2006.01)

(52) U.S. Cl.
CPC ..... *B63H 25/42* (2013.01); *B63H 21/213* (2013.01); *B63H 25/02* (2013.01); *B63H 2025/026* (2013.01); *B63H 2025/425* (2013.01)

(58) Field of Classification Search
CPC ..... B63H 25/42; B63H 25/02; B63H 21/213; B63H 2025/425; B63H 2025/026
See application file for complete search history.

(56) References Cited

U.S. PATENT DOCUMENTS

| | | | | |
|---|---|---|---|---|
| 7,530,863 | B2 * | 5/2009 | Ito | B63H 21/22 440/86 |
| 7,931,513 | B2 * | 4/2011 | Suzuki | B63H 21/21 440/86 |
| 8,016,625 | B2 * | 9/2011 | Suzuki | B63H 23/30 440/1 |
| 8,078,347 | B2 * | 12/2011 | Minoura | B63H 21/22 440/86 |
| 9,248,898 | B1 * | 2/2016 | Kirchhoff | B63H 25/42 |
| 9,709,996 | B2 * | 7/2017 | Ito | B63H 20/20 |
| 2009/0215334 | A1 * | 8/2009 | Suzuki | B63H 23/30 440/85 |
| 2022/0169355 | A1 * | 6/2022 | Tsuchiya | G05D 1/0206 |
| 2023/0264798 | A1 * | 8/2023 | Hara | F02D 41/0215 701/21 |

FOREIGN PATENT DOCUMENTS

| | | | |
|---|---|---|---|
| JP | 2005-145438 | A | 6/2005 |
| JP | 2016-216018 | A | 12/2016 |
| JP | 2017-088111 | A | 5/2017 |
| JP | 6156926 | B2 | 7/2017 |
| KR | 10-2017-0130152 | A | 11/2017 |

* cited by examiner

*Primary Examiner* — S. Joseph Morano
*Assistant Examiner* — Jovon E Hayes
(74) *Attorney, Agent, or Firm* — Keating & Bennett, LLP

(57) ABSTRACT

A marine vessel maneuvering system includes a controller configured or programmed to perform a shift-out start control to control a shift actuator to immediately start an intermittent operation mode from a shift-out state when an intermittent operation switching control is performed to switch a normal operation mode in which a shift-in state continues to the intermittent operation mode in which the shift-in state and the shift-out state are repeated in a predetermined period of time based on a user's operation.

20 Claims, 5 Drawing Sheets

MARINE VESSEL MANEUVERING SYSTEM AND MARINE VESSEL

CROSS REFERENCE TO RELATED APPLICATIONS

This application claims the benefit of priority to Japanese Patent Application No. 2020-200184 filed on Dec. 2, 2020. The entire contents of this application are hereby incorporated herein by reference.

BACKGROUND OF THE INVENTION

1. Field of the Invention

The present invention relates to a marine vessel maneuvering system and a marine vessel, and more particularly, it relates to a marine vessel maneuvering system and a marine vessel both of which include a shift actuator to switch between a shift-in state and a shift-out state.

2. Description of the Related Art

A marine vessel including a shift actuator to switch between a shift-in state and a shift-out state is known in general. Such a marine vessel is disclosed in Japanese Patent No. 6156926, for example.

Japanese Patent No. 6156926 discloses a marine vessel including a vessel body and an outboard motor as a propulsion device attached to the vessel body. The outboard motor of the marine vessel disclosed in Japanese Patent No. 6156926 includes a shift actuator to switch between a shift-in state and a neutral (shift-out) state. In the marine vessel disclosed in Japanese Patent No. 6156926, the shift-in state and the neutral state are alternately repeated in a predetermined period of time such that the marine vessel is navigated at a speed lower than that in a state in which the shift-in state continues. In the marine vessel disclosed in Japanese Patent No. 6156926, after a state in which the shift-in state continues is switched to a state in which the shift-in state and the neutral state are alternately repeated in the predetermined period of time, the state in which the shift-in state and the neutral state are alternately repeated in the predetermined period of time is started from the shift-in state.

In the marine vessel disclosed in Japanese Patent No. 6156926, as described above, after the state in which the shift-in state continues is switched to the state in which the shift-in state and the neutral state are alternately repeated in the predetermined period of time, the state in which the shift-in state and the neutral state are alternately repeated in the predetermined period of time is started from the shift-in state. In such a case, after the state in which the shift-in state continues is switched to the state in which the shift-in state and the neutral state are alternately repeated in the predetermined period of time, the marine vessel continues to be navigated at the same speed as that in the state in which the shift-in state continues before a first shift-in state is switched to a first neutral state. That is, after the state in which the shift-in state continues is switched to the state in which the shift-in state and the neutral state are alternately repeated in the predetermined period of time, the marine vessel is not immediately changed to a state in which the marine vessel is navigated at a speed lower than that in the state in which shift-in continues. In such a case, a user who has performed an operation to change the speed of the marine vessel conceivably feels that the timing of changing the speed of the marine vessel is delayed. Therefore, in a marine vessel navigated at a speed lower than that in a state in which a shift-in state continues by alternately repeating the shift-in state and a neutral (shift-out) state every predetermined period of time, as described in Japanese Patent No. 6156926, improvement in responsiveness to switching from the state in which the shift-in state continues to a state in which the marine vessel is navigated at a speed lower than that in the state in which the shift-in state continues is desired.

SUMMARY OF THE INVENTION

Preferred embodiments of the present invention provide marine vessel maneuvering systems and marine vessels with improved responsiveness to switching from a state in which shift-in states continue to a state in which the marine vessels are navigated at a speed lower than that in the state in which the shift-in states continue.

A marine vessel maneuvering system according to a preferred embodiment of the present invention includes an engine, a propulsive force generator to generate a propulsive force to propel a hull by a driving force from the engine, a shift actuator to switch between a shift-in state in which the driving force is transmitted from the engine to the propulsive force generator and a shift-out state in which the driving force is not transmitted from the engine to the propulsive force generator, and a controller configured or programmed to control the shift actuator to switch between a normal operation mode in which the shift-in state continues and an intermittent operation mode in which the shift-in state and the shift-out state are repeated in a predetermined period of time based on a user's operation. The controller is configured or programmed to perform a shift-out start control to control the shift actuator to immediately start the intermittent operation mode from the shift-out state when an intermittent operation switching control is performed to switch the normal operation mode to the intermittent operation mode based on the user's operation.

In a marine vessel maneuvering system according to a preferred embodiment of the present invention, the controller is configured or programmed to perform the shift-out start control to control the shift actuator to immediately start the intermittent operation mode from the shift-out state when the intermittent operation switching control is performed to switch the normal operation mode to the intermittent operation mode based on the user's operation. Accordingly, after the normal operation mode is switched to the intermittent operation mode, the intermittent operation mode is started from the shift-out state. That is, unlike a case in which the intermittent operation mode is started from the shift-in state, a marine vessel is immediately changed to a state in which the marine vessel is navigated at a speed lower than that in the normal operation mode after the normal operation mode is switched to the intermittent operation mode. Consequently, responsiveness to switching from a state in which the shift-in state continues to a state in which the marine vessel is navigated at a speed lower than that in the state in which the shift-in state continues is improved. That is, the possibility that the user who has performed an operation to change the speed of the marine vessel feels that the timing of changing the speed of the marine vessel is delayed is significantly reduced or prevented.

In a marine vessel maneuvering system according to a preferred embodiment of the present invention, the controller is preferably configured or programmed to switch the shift-in state to the shift-out state at a predetermined timing corresponding to the predetermined period of time in the intermittent operation mode, and perform the shift-out start control by shifting the predetermined timing when the intermittent operation switching control is performed. Accordingly, regardless of the timing at which the intermittent operation switching control is performed, the shift-out start control is performed when the intermittent operation switching control is performed.

In such a case, the controller is preferably configured or programmed to perform the shift-out start control by resetting a timer set to the predetermined period of time and shifting the predetermined timing when the intermittent operation switching control is performed. Accordingly, the timer is reset to easily shift the predetermined timing in order to perform the shift-out start control when the intermittent operation switching control is performed.

A marine vessel maneuvering system according to a preferred embodiment of the present invention preferably further includes an operator to adjust a speed of a marine vessel, and the controller is preferably configured or programmed to perform the shift-out start control when the user performs an operation on the operator to reduce the speed of the marine vessel to be lower than a predetermined speed. Accordingly, after the normal operation mode is switched to the intermittent operation mode based on the user's operation to reduce the speed of the marine vessel to be lower than the predetermined speed, the marine vessel is immediately changed to a state in which the marine vessel is navigated at a speed lower than that in the normal operation mode.

In such a case, the controller is preferably configured or programmed to perform the shift-out start control at a ratio between a duration of the shift-in state and a duration of the shift-out state according to the speed of the marine vessel when the user performs the operation on the operator to reduce the speed of the marine vessel to be lower than the predetermined speed. Accordingly, after the normal operation mode is switched to the intermittent operation mode, the marine vessel is immediately changed to a state in which the marine vessel is navigated at a speed lower than that in the normal operation mode and a speed according to the user's operation to change the speed of the marine vessel.

In a marine vessel maneuvering system according to a preferred embodiment of the present invention, the controller is preferably configured or programmed to perform the shift-out start control when the intermittent operation switching control is performed in an automatic navigation mode in which navigation of a marine vessel is automatically controlled. Accordingly, when the marine vessel is automatically navigated, the responsiveness to switching from a state in which the shift-in state continues to a state in which the marine vessel is navigated at a speed lower than that in the state in which the shift-in state continues is improved.

A marine vessel maneuvering system according to a preferred embodiment of the present invention preferably further includes a display to display whether or not the marine vessel maneuvering system is in the intermittent operation mode, and the controller is preferably configured or programmed to control the display to display that the marine vessel maneuvering system is in the intermittent operation mode and perform the shift-out start control when the intermittent operation switching control is performed. Accordingly, the user visually recognizes that the marine vessel maneuvering system is in the intermittent operation mode (the state in which the marine vessel is navigated at a speed lower than that in the state in which the shift-in state continues) without feeling a time lag, while the responsiveness to switching from a state in which the shift-in state continues to a state in which the marine vessel is navigated at a speed lower than that in the state in which the shift-in state continues is improved.

In a marine vessel maneuvering system according to a preferred embodiment of the present invention, the controller is preferably configured or programmed to perform the shift-out start control when the intermittent operation switching control is performed when a marine vessel is navigated either forward or rearward. Accordingly, when the marine vessel is moving forward or rearward, the responsiveness to switching from a state in which the shift-in state continues to a state in which the marine vessel is navigated at a speed lower than that in the state in which the shift-in state continues is improved.

A marine vessel maneuvering system according to a preferred embodiment of the present invention preferably further includes an operator to adjust a speed of a marine vessel, and the controller is preferably configured or programmed to perform an adjustment shift-out start control to control the shift actuator to immediately start the intermittent operation mode, in which a ratio between a duration of the shift-in state and a duration of the shift-out state has been adjusted according to the speed of the marine vessel, from the shift-out state based on the user's operation when the user performs a speed change operation to change the speed of the marine vessel on the operator in the intermittent operation mode. Accordingly, the intermittent operation mode in which the ratio between the duration of the shift-in state and the duration of the shift-out state has been adjusted according to the speed of the marine vessel is started from the shift-out state. That is, unlike a case in which the intermittent operation mode in which the ratio between the duration of the shift-in state and the duration of the shift-out state has been adjusted according to the speed of the marine vessel is started from the shift-in state, the marine vessel is immediately changed to a state in which the marine vessel is navigated at a speed changed by the user. Consequently, responsiveness to switching a speed at which the marine vessel is navigated is improved in a state in which the marine vessel is navigated at a speed lower than that in the state in which the shift-in state continues.

In such a case, the controller is preferably configured or programmed to switch the shift-in state to the shift-out state at a predetermined timing corresponding to the predetermined period of time in the intermittent operation mode, and perform the adjustment shift-out start control when the user performs the speed change operation on the operator in the intermittent operation mode. Accordingly, in the intermittent operation mode, the adjustment shift-out start control is performed when the ratio between the duration of the shift-in state and the duration of the shift-out state is adjusted according to the speed of the marine vessel regardless of the timing at which the speed change operation is performed on the operator by the user.

In a marine vessel maneuvering system including the controller configured or programmed to switch the shift-in state to the shift-out state at the predetermined timing corresponding to the predetermined period of time in the intermittent operation mode, the controller is preferably configured or programmed to perform the adjustment shift-out start control by resetting a timer set to the predetermined period of time and shifting the predetermined timing when the user performs the speed change operation on the operator in the intermittent operation mode. Accordingly, the timer is reset to easily shift the predetermined timing in order to perform the adjustment shift-out start control when the ratio between the duration of the shift-in state and the duration of the shift-out state is adjusted according to the speed of the marine vessel.

In a marine vessel maneuvering system including the controller configured or programmed to perform the adjustment shift-out start control when the user performs the speed change operation in the intermittent operation mode, the controller is preferably configured or programmed to perform the adjustment shift-out start control when the user performs the speed change operation on the operator in an automatic navigation mode in which navigation of the marine vessel is automatically controlled. Accordingly, the responsiveness to switching a speed at which the marine vessel is navigated is improved in a state in which the marine vessel is navigated at a speed lower than that in the state in which the shift-in state continues when the marine vessel is automatically navigated.

A marine vessel maneuvering system including the controller configured or programmed to perform the adjustment shift-out start control when the user performs the speed change operation in the intermittent operation mode preferably further includes a display to display the speed of the marine vessel, and the controller is preferably configured or programmed to control the display to display a changed speed of the marine vessel and perform the adjustment shift-out start control when the user performs the speed change operation on the operator in the intermittent operation mode. Accordingly, the user visually recognizes that the speed of the marine vessel has been changed without feeling a time lag, while the responsiveness to switching a speed at which the marine vessel is navigated is improved in a state in which the marine vessel is navigated at a speed lower than that in the state in which the shift-in state continues.

A marine vessel according to a preferred embodiment of the present invention includes a hull, and an outboard motor attached to the hull. The outboard motor includes an engine, a propulsive force generator to generate a propulsive force to propel the hull by a driving force from the engine, a shift actuator to switch between a shift-in state in which the driving force is transmitted from the engine to the propulsive force generator and a shift-out state in which the driving force is not transmitted from the engine to the propulsive force generator, and a controller configured or programmed to control the shift actuator to switch between a normal operation mode in which the shift-in state continues and an intermittent operation mode in which the shift-in state and the shift-out state are repeated in a predetermined period of time based on a user's operation. The controller is configured or programmed to perform a shift-out start control to control the shift actuator to immediately start the intermittent operation mode from the shift-out state when an intermittent operation switching control is performed to switch the normal operation mode to the intermittent operation mode based on the user's operation.

In a marine vessel according to a preferred embodiment of the present invention, the controller is configured or programmed to perform the shift-out start control to control the shift actuator to immediately start the intermittent operation mode from the shift-out state when the intermittent operation switching control is performed to switch the normal operation mode to the intermittent operation mode based on the user's operation. Accordingly, similarly to the marine vessel maneuvering systems according to preferred embodiments of the present invention described above, after the normal operation mode is switched to the intermittent operation mode, the intermittent operation mode is started from the shift-out state. Consequently, similarly to the marine vessel maneuvering systems according to preferred embodiments of the present invention described above, responsiveness to switching from a state in which the shift-in state continues to a state in which the marine vessel is navigated at a speed lower than that in the state in which the shift-in state continues is improved. That is, the possibility that the user who has performed an operation to change the speed of the marine vessel feels that the timing of changing the speed of the marine vessel is delayed is significantly reduced or prevented.

In a marine vessel according to a preferred embodiment of the present invention, the controller is preferably configured or programmed to switch the shift-in state to the shift-out state at a predetermined timing corresponding to the predetermined period of time in the intermittent operation mode, and perform the shift-out start control by shifting the predetermined timing when the intermittent operation switching control is performed. Accordingly, similarly to the marine vessel maneuvering systems according to preferred embodiments of the present invention described above, regardless of the timing at which the intermittent operation switching control is performed, the shift-out start control is performed when the intermittent operation switching control is performed.

In such a case, the controller is preferably configured or programmed to perform the shift-out start control by resetting a timer set to the predetermined period of time and shifting the predetermined timing when the intermittent operation switching control is performed. Accordingly, similarly to the marine vessel maneuvering systems according to preferred embodiments of the present invention described above, the timer is reset to easily shift the predetermined timing in order to perform the shift-out start control when the intermittent operation switching control is performed.

A marine vessel according to a preferred embodiment of the present invention preferably further includes an operator to adjust a speed of the marine vessel, and the controller is preferably configured or programmed to perform the shift-out start control when the user performs an operation on the operator to reduce the speed of the marine vessel to be lower than a predetermined speed. Accordingly, similarly to the marine vessel maneuvering systems according to preferred embodiments of the present invention described above, after the normal operation mode is switched to the intermittent operation mode based on the user's operation to reduce the speed of the marine vessel to be lower than the predetermined speed, the marine vessel is immediately changed to a state in which the marine vessel is navigated at a speed lower than that in the normal operation mode.

In such a case, the controller is preferably configured or programmed to perform the shift-out start control at a ratio between a duration of the shift-in state and a duration of the shift-out state according to the speed of the marine vessel when the user performs the operation on the operator to reduce the speed of the marine vessel to be lower than the predetermined speed. Accordingly, similarly to the marine vessel maneuvering systems according to preferred embodiments of the present invention described above, after the normal operation mode is switched to the intermittent operation mode, the marine vessel is immediately changed to a state in which the marine vessel is navigated at a speed lower than that in the normal operation mode and a speed according to the user's operation to change the speed of the marine vessel.

In a marine vessel according to a preferred embodiment of the present invention, the controller is preferably configured or programmed to perform the shift-out start control when the intermittent operation switching control is performed in an automatic navigation mode in which navigation of the marine vessel is automatically controlled. Accordingly, similarly to the marine vessel maneuvering systems according to preferred embodiments of the present invention described above, when the marine vessel is automatically navigated, the responsiveness to switching from a state in which the shift-in state continues to a state in which the marine vessel is navigated at a speed lower than that in the state in which the shift-in state continues is improved.

A marine vessel according to a preferred embodiment of the present invention preferably further includes a display to display whether or not the marine vessel is in the intermittent operation mode, and the controller is preferably configured or programmed to control the display to display that the marine vessel is in the intermittent operation mode and perform the shift-out start control when the intermittent operation switching control is performed. Accordingly, similarly to the marine vessel maneuvering systems according to preferred embodiments of the present invention described above, the user visually recognizes that the marine vessel is in the intermittent operation mode (the state in which the marine vessel is navigated at a speed lower than that in the state in which the shift-in state continues) without feeling a time lag, while the responsiveness to switching from a state in which the shift-in state continues to a state in which the marine vessel is navigated at a speed lower than that in the state in which the shift-in state continues is improved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel maneuvering system 100 and the structure of a marine vessel 110 according to preferred embodiments of the present invention is now described with reference to FIGS. 1 to 8. The marine vessel maneuvering system 100 maneuvers the marine vessel 110. The marine vessel maneuvering system 100 is provided in the marine vessel 110.

Figure 1:
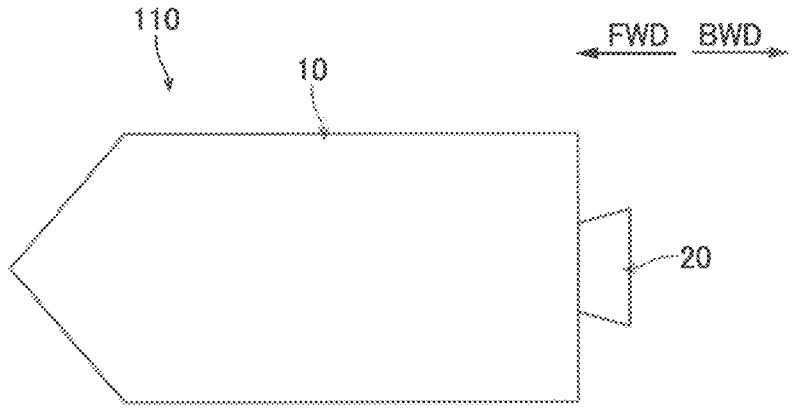
FIG. 1 is a schematic view showing a marine vessel according to a preferred embodiment of the present invention.

As shown in FIG. 1, the marine vessel 110 (marine vessel maneuvering system 100 (see FIG. 3)) includes a hull 10 and an outboard motor 20. The outboard motor 20 is attached to the rear of the hull 10. The outboard motor 20 is a marine propulsion unit to propel the hull 10. The marine vessel 110 is used for sightseeing in a canal and a lake, for example. The marine vessel 110 is a relatively small marine vessel. Arrow FWD and arrow BWD in FIG. 1 represent the front side and the rear side of the marine vessel 110, respectively.

Figure 2:
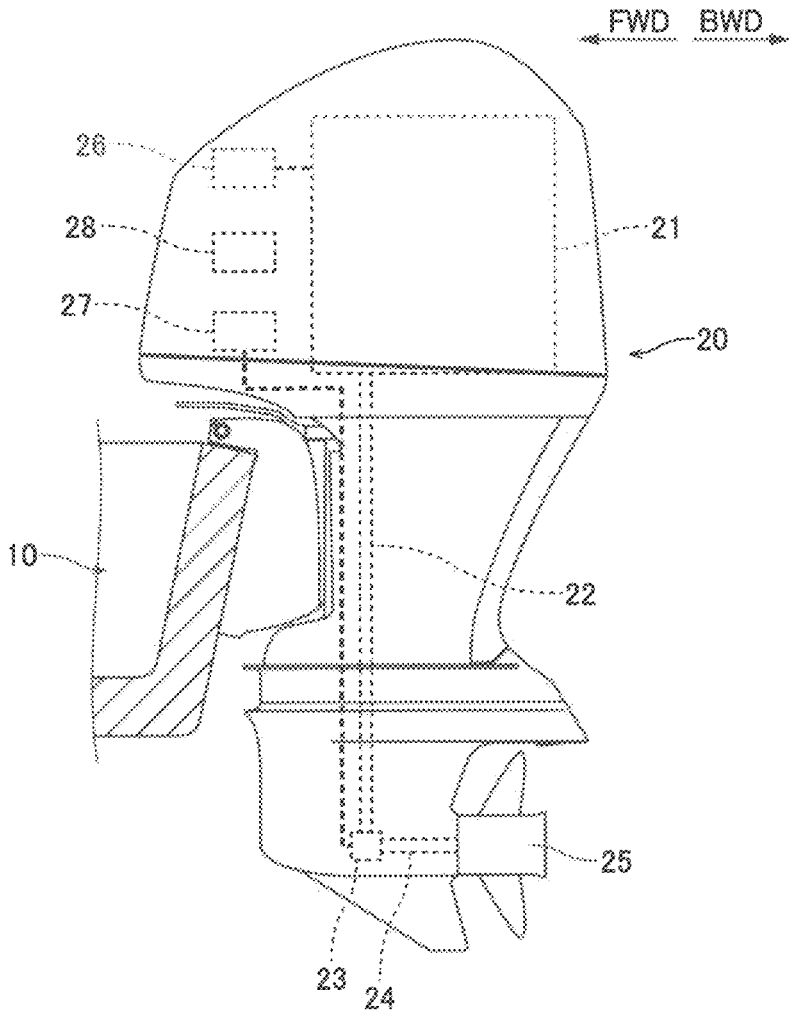
FIG. 2 is a side view showing the structure of an outboard motor according to a preferred embodiment of the present invention.

As shown in FIG. 2, the outboard motor 20 includes an engine 21, a drive shaft 22, a gearing 23, a propeller shaft 24, and a propeller 25. The propeller 25 is an example of a "propulsive force generator".

The engine 21 is, for example, an internal combustion engine that generates a driving force by explosive combustion of fuel in a combustion chamber. The drive shaft 22 is connected to a crankshaft (not shown) of the engine 21 so as to transmit the driving force from the engine 21. The drive shaft 22 rotates by the driving force transmitted from the engine 21 via the crankshaft. The gearing 23 reduces the rotational speed of the drive shaft 22 and transmits it to the propeller shaft 24. The propeller 25 is connected to the propeller shaft 24. The propeller 25 generates a thrust force by rotating in the water by the driving force transmitted from the engine 21 via the crankshaft (not shown), the drive shaft 22, the gearing 23, and the propeller shaft 24. That is, the propeller 25 generates a propulsive force to propel the hull 10 by the driving force from the engine 21.

The outboard motor 20 includes a throttle actuator 26 and a shift actuator 27. The throttle actuator 26 controls the throttle opening degree of the engine 21. The shift actuator 27 switches between a shift-in state in which the driving force is transmitted from the engine 21 to the propeller 25 and a shift-out state in which the driving force is not transmitted from the engine 21 to the propeller 25. Specifically, the shift actuator 27 switches between the shift-in state and the shift-out state by switching the meshing of the gearing 23.

The gearing 23 includes a pinion gear, a forward movement bevel gear, a reverse movement bevel gear, and a dog clutch. The pinion gear is attached to the drive shaft 22. The forward movement bevel gear and the reverse movement bevel gear are provided on the propeller shaft 24 so as to sandwich the pinion gear therebetween. The pinion gear meshes with the forward movement bevel gear and the reverse movement bevel gear. When the dog clutch that rotates integrally with the propeller shaft 24 meshes with either the forward movement bevel gear or the reverse movement bevel gear (shift-in state), the gearing 23 transmits the driving force from the engine 21 via the propeller shaft 24. When the dog clutch meshes with neither the forward movement bevel gear nor the reverse movement bevel gear (neutral state, shift-out state), the gearing 23 does not transmit the driving force from the engine 21 to the propeller 25. The gearing 23 rotates the propeller shaft 24 in the forward movement direction and the reverse movement direction of the marine vessel 110 in a state in which the dog clutch meshes with the forward movement bevel gear (forward movement state) and a state in which the dog clutch meshes with the reverse movement bevel gear (reverse movement state), respectively.

Figure 3:
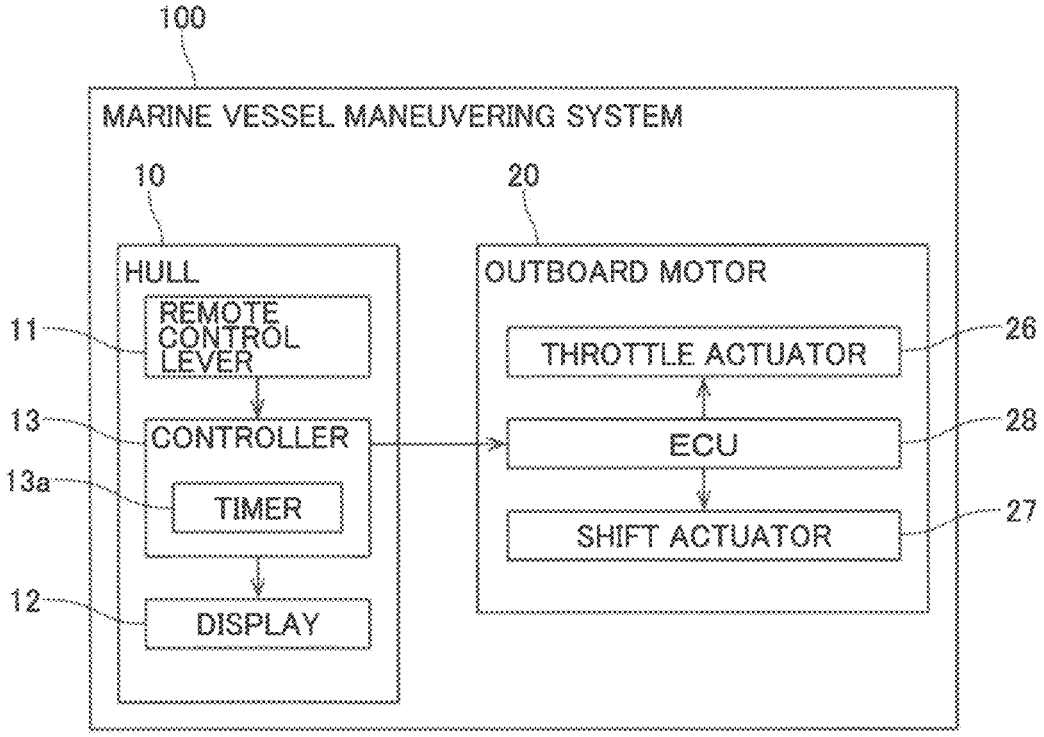
FIG. 3 is a block diagram showing the structure of a marine vessel maneuvering system according to a preferred embodiment of the present invention.

As shown in FIG. 3, the hull 10 includes a remote control lever 11, a display 12, and a controller 13. The outboard motor 20 includes an engine control unit (ECU) 28. The remote control lever 11 is an example of an "operator".

Figure 4:
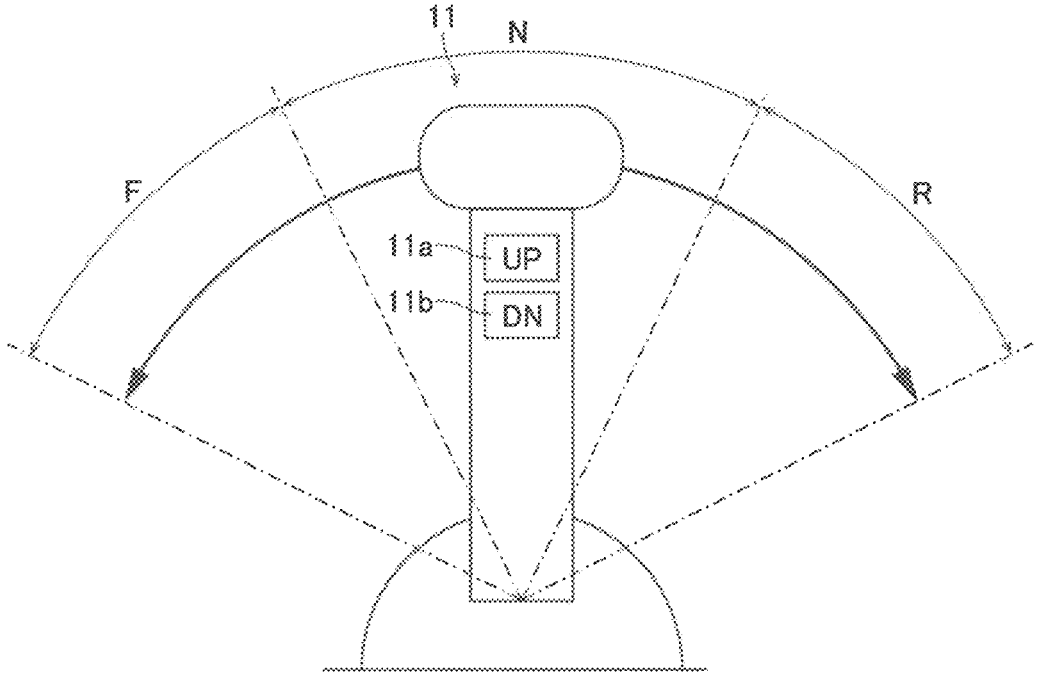
FIG. 4 is a schematic view showing a remote control lever of a marine vessel according to a preferred embodiment of the present invention.

As shown in FIG. 4, the remote control lever 11 is tiltable in a forward-rearward direction. The remote control lever 11 receives an operation to adjust the throttle opening degree of the engine 21 (see FIG. 2) and an operation to switch a shift state (the forward movement state, the neutral state, or the reverse movement state).

Specifically, the position of the remote control lever 11 between a position tilted forward by a predetermined angle and a position tilted rearward by a predetermined angle is set as a neutral position (N). The position of the remote control lever 11 tilted forward from the neutral position is set as a forward movement position (F). The position of the remote control lever 11 tilted rearward from the neutral position is set as a reverse movement position (R). The magnitude of the tilt angle of the remote control lever 11 at the forward movement position and the reverse movement position corresponds to the magnitude of the throttle opening degree of the engine 21 (see FIG. 2).

When the remote control lever 11 is operated so as to be located at the neutral position (N) in a manual navigation mode, the controller 13 (see FIG. 3) controls the outboard motor 20 to be in the neutral state (shift-out state). When the remote control lever 11 is operated so as to be located at the forward movement position (F) in the manual navigation mode, the controller 13 controls the outboard motor 20 to be in the forward movement state (shift-in state). When the remote control lever 11 is operated so as to be located at the reverse movement position (R) in the manual navigation mode, the controller 13 controls the outboard motor 20 so as to be in the reverse movement state (shift-in state). The manual navigation mode refers to an operation mode in which the controller 13 controls navigation of the marine vessel 110 (see FIG. 1) based on a user's operation to change the tilt angle on the remote control lever 11. That is, the manual navigation mode is an operation mode in which navigation of the marine vessel 110 is manually controlled.

The remote control lever 11 includes an UP button 11*a* and a DOWN button 11*b*. The UP button 11*a* and the DOWN button 11*b* are provided for an automatic navigation mode. The automatic navigation mode refers to an operation mode in which the controller 13 (see FIG. 3) automatically controls navigation of the marine vessel 110 such that the speed of the marine vessel 110 (see FIG. 1) is maintained at a target vessel speed set by the user based on a user's operation on the UP button 11*a* and DOWN button 11*b* of the remote control lever 11.

Specifically, when the DOWN button 11*b* is pressed in the manual navigation mode, the controller 13 (see FIG. 3) performs a control to transition the manual navigation mode to the automatic navigation mode. In the marine vessel maneuvering system 100 (see FIG. 3), when the DOWN button 11*b* is pressed while the remote control lever 11 is located at the forward movement position (F) or the reverse movement position (R), the controller 13 performs a control to transition the manual navigation mode to the automatic navigation mode. That is, when the DOWN button 11*b* is pressed while the remote control lever 11 is located at the neutral position (N), the controller 13 does not perform a control to transition the manual navigation mode to the automatic navigation mode.

When the UP button 11*a* is pressed in the automatic navigation mode, the controller 13 (see FIG. 3) performs a control to increase the magnitude of the throttle opening degree of the engine 21. When the DOWN button 11*b* is pressed in the automatic navigation mode, the controller 13 performs a control to reduce the magnitude of the throttle opening degree of the engine 21. In the marine vessel maneuvering system 100 (see FIG. 3), when the tilt angle of the remote control lever 11 is changed in the automatic navigation mode, the controller 13 performs a control to cancel the automatic navigation mode (i.e., the automatic navigation mode is transitioned to the manual navigation mode). That is, in the automatic navigation mode, the remote control lever 11 is located at the forward movement position (F) or the reverse movement position (R).

Figure 5:
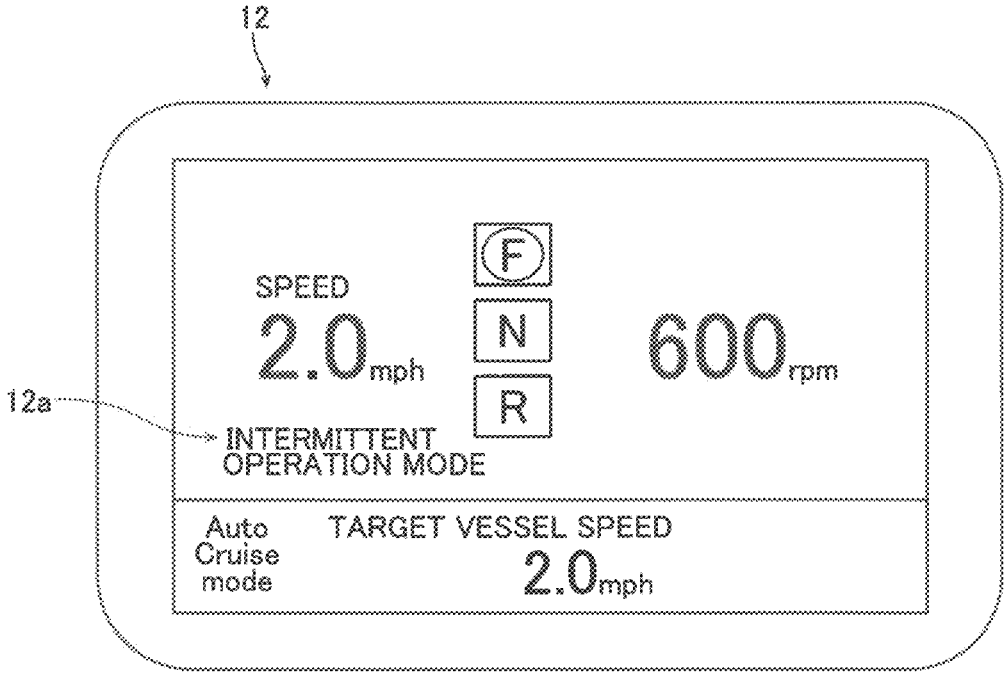
FIG. 5 is a schematic view showing a display of a marine vessel according to a preferred embodiment of the present invention.

As shown in FIG. 5, the display 12 displays information on the marine vessel 110 (see FIG. 1). The information on the marine vessel 110 includes the speed of the marine vessel 110 (vessel speed), the rotation speed of the engine 21, the shift state (the forward movement state, the neutral state, or the reverse movement state), the navigation mode (the manual navigation mode or the automatic navigation mode), and whether or not the marine vessel maneuvering system 100 (marine vessel 110) is in the intermittent operation mode (described below), for example. The display 12 is a liquid crystal display, for example. Note that FIG. 5 shows a display example of the display 12 in the automatic navigation mode (auto cruise mode). Furthermore, F, N, and R in FIG. 5 indicate the forward movement state, the neutral movement state, and the reverse movement state, respectively, and the current shift state is circled (i.e., FIG. 5 shows a display example in the forward movement state).

As shown in FIG. 3, the controller 13 controls the ECU 28 based on a user's operation on the remote control lever 11, for example. For example, the controller 13 controls the ECU 28 based on the shift state and the tilt angle of the remote control lever 11 in the manual navigation mode. Furthermore, when the UP button 11*a* or the DOWN button 11*b* of the remote control lever 11 is pressed in the automatic navigation mode, the controller 13 controls the ECU 28 such that the speed of the marine vessel 110 becomes the set target vessel speed. The ECU 28 controls the throttle actuator 26 and the shift actuator 27 based on a control by the controller 13. The controller 13 and the ECU 28 include circuit boards including a central processing unit (CPU), a read-only memory (ROM), a random access memory (RAM), etc., for example.

The controller 13 controls the shift actuator 27 to switch between a normal operation mode in which the shift-in state continues (i.e., the shift-in state is continuous) and the intermittent operation mode in which the shift-in state and the shift-out state are repeated in a predetermined period of time T (see FIG. 7) based on a user's operation on the remote control lever 11. In the marine vessel maneuvering system 100, the controller 13 performs a control to switch between the normal operation mode and the intermittent operation mode in the automatic navigation mode.

Figure 6:
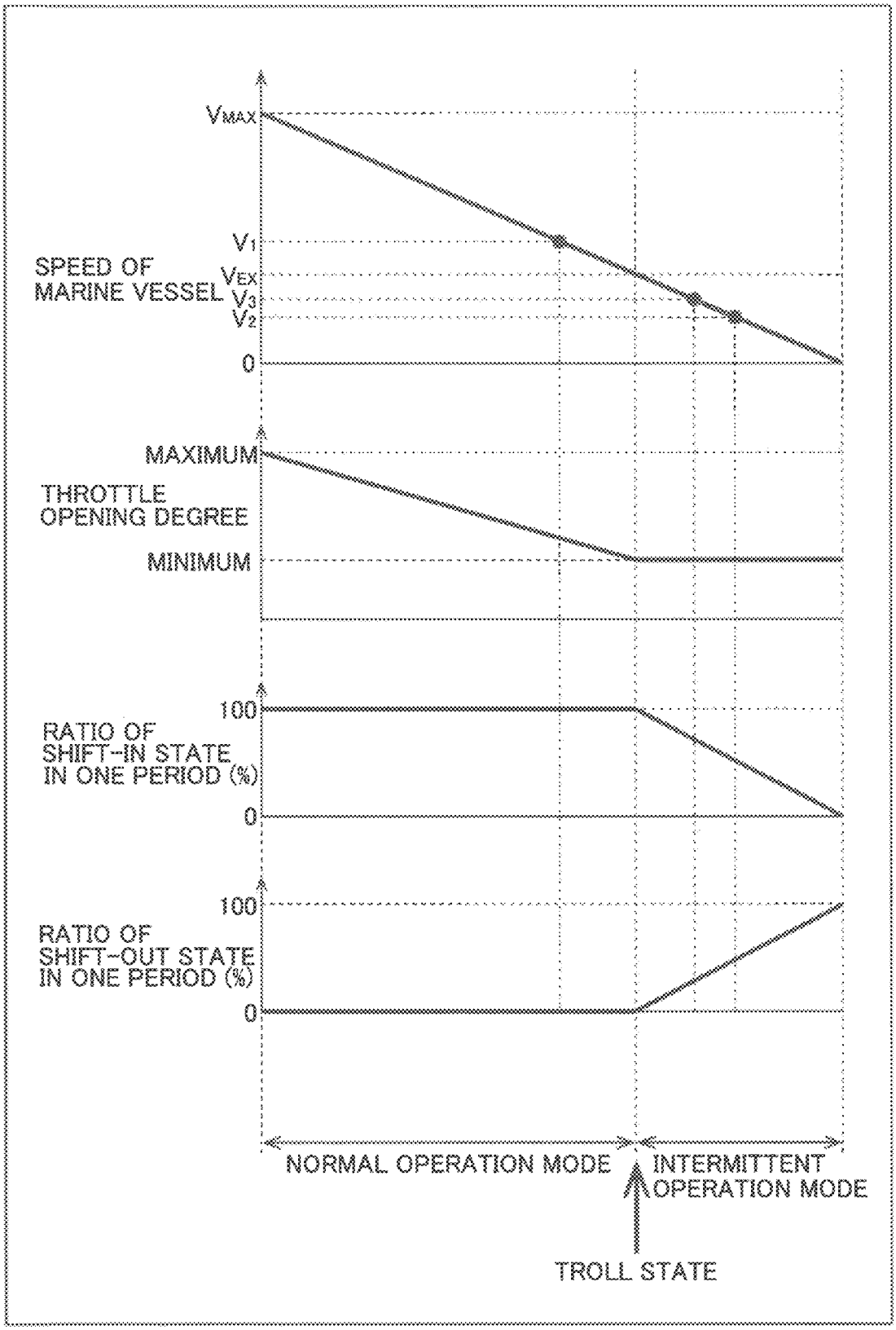
FIG. 6 is a diagram illustrating a relationship between a speed of a marine vessel and both a throttle opening degree and a shift state according to a preferred embodiment of the present invention.

Specifically, as shown in FIG. 6, the controller 13 (see FIG. 3) controls the shift actuator 27 (see FIG. 3) via the ECU 28 such that the marine vessel maneuvering system 100 (marine vessel 110) is in the normal operation mode in which the shift-in state continues when the speed of the marine vessel 110 set by the user is equal to or higher than a predetermined speed $V_{EX}$ in the automatic navigation mode. Furthermore, the controller 13 controls the shift actuator 27 via the ECU 28 such that the marine vessel maneuvering system 100 (marine vessel 110) is in the intermittent operation mode in which the shift-in state and the shift-out state are repeated in the predetermined period T (see FIG. 7) when the speed of the marine vessel 110 set by the user is lower than the predetermined speed $V_{EX}$ in the automatic navigation mode.

The controller 13 controls the shift actuator 27 via the ECU 28 such that the shift-in state and the shift-out state are repeated in the predetermined period T based on a timer 13*a* (see FIG. 3) set to the predetermined period T in the automatic navigation mode. The predetermined period is a few seconds, for example. The timer 13*a* starts the countdown at the timing of switching from the normal operation mode to the intermittent operation mode.

The speed of the marine vessel 110 (the propulsive force of the marine vessel 110) corresponds to the throttle opening degree of the engine 21 and the shift state (the shift-in state or the shift-out state) of the outboard motor 20. A state in which the speed of the marine vessel 110 is a maximum speed $V_{MAX}$ corresponds to a state in which the outboard motor 20 is in the shift-in state and the throttle opening degree of the engine 21 is maximum. A state in which the speed of the marine vessel 110 is the predetermined speed $V_{EX}$ corresponds to a state in which the outboard motor 20 is in the shift-in state and the throttle opening degree of the engine 21 is minimum. That is, the state in which the speed of the marine vessel 110 is the predetermined speed $V_{EX}$ is a so-called troll state. A state in which the speed of the marine vessel 110 is between the maximum speed $V_{MAX}$ and the predetermined speed $V_{EX}$ corresponds to a state in which the outboard motor 20 is in the shift-in state and the magnitude of the throttle opening degree of the engine 21 and the magnitude of the speed of the marine vessel 110 are correlated (proportional) to each other.

On the other hand, a state in which the speed of the marine vessel 110 is lower than the predetermined speed $V_{EX}$ corresponds to a state in which the throttle opening degree is minimum and the ratio of the shift-in state and the magnitude of the speed of the marine vessel 110 are correlated (proportional) to each other. That is, in the marine vessel maneuvering system 100, when the speed of the marine vessel 110 is lower than the predetermined speed $V_{EX}$, the speed of the marine vessel 110 (the propulsive force of the marine vessel 110) changes according to a ratio between the duration $T_{10}$ (see FIG. 7) of the shift-in state and the duration $T_{20}$ (see FIG. 7) of the shift-out state. Therefore, the controller 13 (see FIG. 3) controls the shift actuator 27 (see FIG. 3) via the ECU 28 (see FIG. 3) such that the shift-in state and the shift-out state are repeated with the predetermined period T at the ratio between the duration $T_{10}$ of the shift-in state and the duration $T_{20}$ of the shift-out state according to the speed of the marine vessel 110 set by the user when the speed of the marine vessel 110 set by the user is set to be lower than the predetermined speed $V_{EX}$ in the automatic navigation mode.

Figure 7:
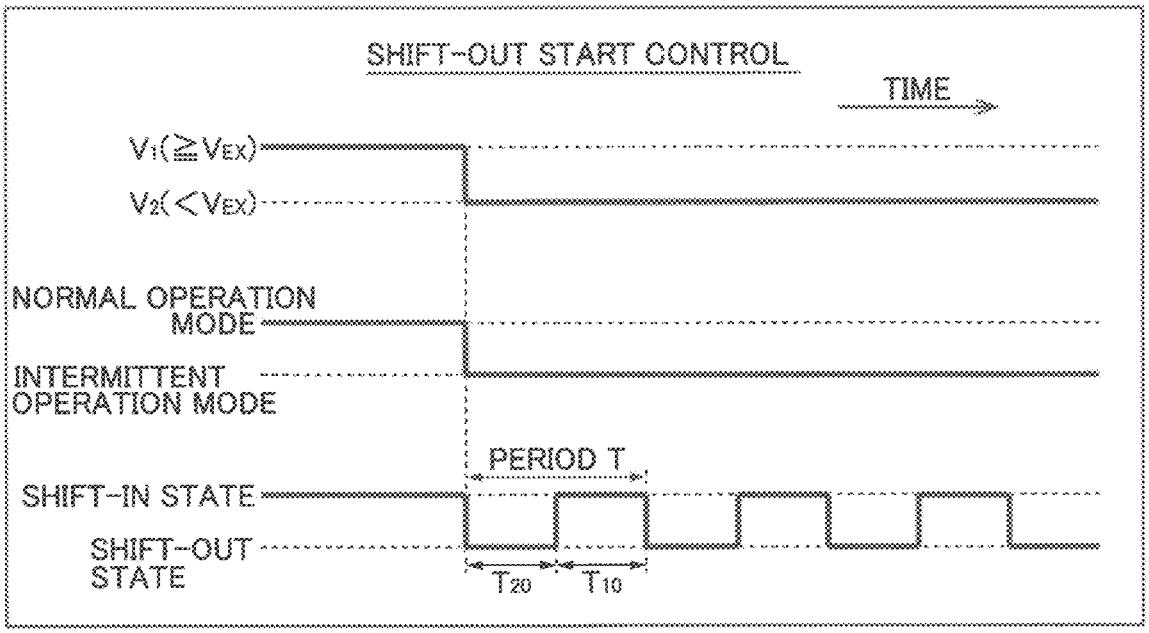
FIG. 7 is a diagram illustrating a control to switch a normal operation mode of a marine vessel maneuvering system to an intermittent operation mode according to a preferred embodiment of the present invention.

In preferred embodiments of the present invention, as shown in FIG. 7, the controller 13 (see FIG. 3) performs a shift-out start control to control the actuator 27 (see FIG. 3) so as to immediately start the intermittent operation mode from the shift-out state when an intermittent operation switching control is performed to switch the normal operation mode to the intermittent operation mode based on a user's operation (on the DOWN button 11*b* of the remote control lever 11) to change the speed of the marine vessel 110 so as to be lower than the predetermined speed $V_{EX}$ in the automatic navigation mode.

Specifically, the controller 13 (see FIG. 3) switches the shift-in state to the shift-out state at the predetermined timing corresponding to the predetermined period T in the intermittent operation mode. Specifically, in the marine vessel maneuvering system 100 (see FIG. 3), the shift-in state is switched to the shift-out state only at the timing at which the timer 13*a* (see FIG. 3) reaches zero count (the predetermined timing corresponding to each predetermined period T). Therefore, after the user performs an operation to change the speed of the marine vessel 110 from a speed $V_1$ higher than the predetermined speed $V_{EX}$ to a speed $V_2$ lower than the predetermined speed $V_{EX}$ in the automatic navigation mode, the speed of the marine vessel 110 does not change from the predetermined speed $V_{EX}$ until the timer 13*a* reaches zero count.

Therefore, in preferred embodiments of the present invention, the controller 13 (see FIG. 3) performs the shift-out start control by resetting the timer 13*a* (see FIG. 3) set to the predetermined period T and shifting the predetermined timing when the intermittent operation switching control is performed in the automatic navigation mode. Thus, immediately after the user performs the operation to change the speed of the marine vessel 110 from the speed $V_1$ higher than the predetermined speed $V_{EX}$ to the speed $V_2$ lower than the predetermined speed $V_{EX}$ in the automatic navigation mode, the speed of the marine vessel 110 changes to be closer to the speed $V_2$, which is lower than the predetermined speed $V_{EX}$.

As described above, the controller 13 (see FIG. 3) controls the shift actuator 27 (see FIG. 3) via the ECU 28 (see FIG. 3) such that the shift-in state and the shift-out state are repeated in the predetermined period T at the ratio between the duration $T_{10}$ of the shift-in state and the duration $T_{20}$ of the shift-out state according to the speed of the marine vessel 110 set by the user when the speed of the marine vessel 110 set by the user is set to be lower than the predetermined speed $V_{EX}$ in the automatic navigation mode. That is, in preferred embodiments of the present invention, the controller 13 performs the shift-out start control at the ratio between the duration $T_{10}$ of the shift-in state and the duration $T_{20}$ of the shift-out state according to the speed of the marine vessel 110 when the user performs an operation on the remote control lever 11 (see FIG. 4) to reduce the speed of the marine vessel 110 to be lower than the predetermined speed $V_{EX}$ in the automatic navigation mode.

In preferred embodiments of the present invention, the controller 13 (see FIG. 3) controls the display 12 to display that the marine vessel maneuvering system 100 (marine vessel 110) is in the intermittent operation mode and performs the shift-out start control when the intermittent operation switching control is performed. Specifically, as shown in FIG. 5, the controller 13 controls the display 12 to display characters 12*a* "intermittent operation mode" substantially concurrently with switching the normal operation mode to the intermittent operation mode.

As described above, the shift-out start control is performed in the automatic navigation mode. Furthermore, as described above, in the automatic navigation mode, the remote control lever 11 is located at the forward movement position (F) or the reverse movement position (R). That is, in preferred embodiments of the present invention, the controller 13 (see FIG. 3) performs the shift-out start control when the intermittent operation switching control is performed when the marine vessel 110 is navigated either forward or rearward.

Figure 8:
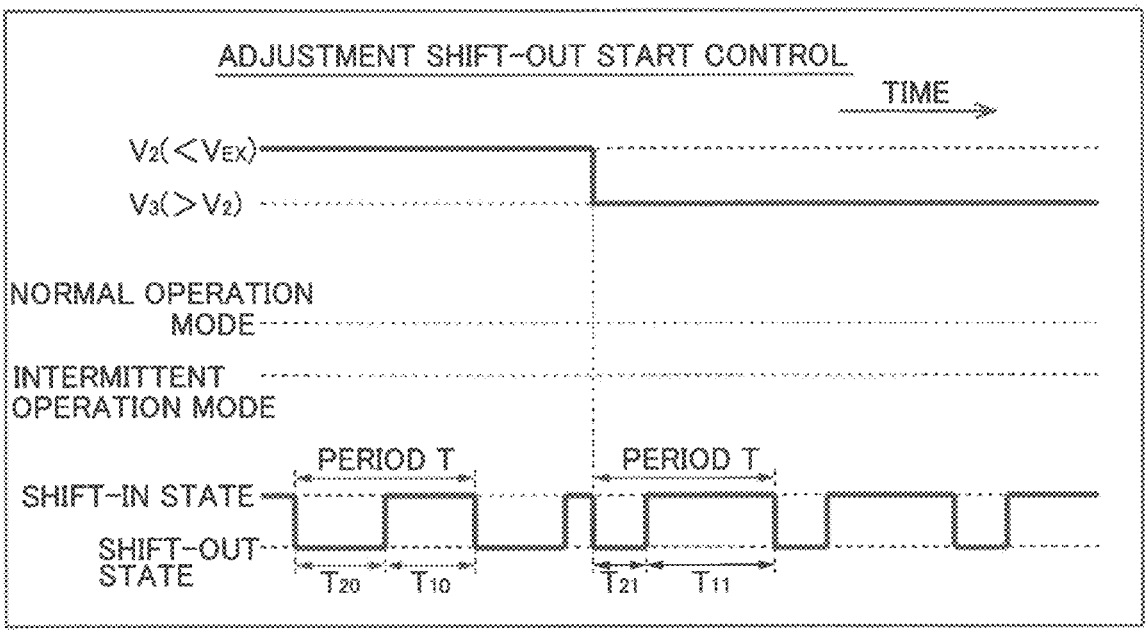
FIG. 8 is a diagram illustrating a control to adjust a ratio between the duration of a shift-in state and the duration of a shift-out state when an operation is performed to change the speed of a marine vessel in an intermittent operation mode of a marine vessel maneuvering system according to a preferred embodiment of the present invention.

As shown in FIG. 8, in preferred embodiments of the present invention, the controller 13 (see FIG. 3) performs an adjustment shift-out start control to control the shift actuator (see FIG. 3) so as to immediately start the intermittent operation mode, in which the ratio between the duration $T_{10}$ of shift-in state and the duration 120 of the shift-out state has been adjusted according to the speed of the marine vessel 110, from the shift-out state based on a user's operation when the user performs a speed change operation to change the speed of the marine vessel 110 on the remote control lever 11 in the intermittent operation mode in the automatic navigation mode.

Specifically, as described above, in the marine vessel maneuvering system 100 (see FIG. 3), the shift-in state is switched to the shift-out state only at the timing at which the timer 13*a* (see FIG. 3) reaches zero count (the predetermined timing corresponding to each predetermined period T). Therefore, after the user performs the speed change operation to change the speed of the marine vessel 110 on the remote control lever 11 in the automatic navigation mode, the speed of the marine vessel 110 does not change from the speed before the change by the user until the timer 13*a* reaches zero count.

Therefore, in preferred embodiments of the present invention, the controller 13 (see FIG. 3) performs the adjustment shift-out start control by resetting the timer 13*a* (see FIG. 3) set to the predetermined period T and shifting the predetermined timing when the user performs the speed change operation on the remote control lever 11 (see FIG. 4) in the intermittent operation mode. Thus, immediately after the user performs the speed change operation to change the speed of the marine vessel 110 on the remote control lever 11 in the automatic navigation mode, the speed of the marine vessel 110 changes to be closer to a speed that has been changed by the user.

Note that FIG. 8 shows an example in which the speed of the marine vessel 110 is changed from the speed $V_2$ lower than the predetermined speed $V_{EX}$ to a speed $V_3$ lower than the predetermined speed $V_{EX}$ and higher than the speed $V_2$. That is, the duration $T_{11}$ of the shift-in state in a case in which the speed of the marine vessel 110 is the speed $V_3$ is longer than the duration $T_{10}$ of the shift-in state in a case in which the speed of the marine vessel 110 is the speed $V_2$, and the duration 121 of the shift-out state in a case in which the speed of the marine vessel 110 is the speed $V_3$ is shorter than the duration 120 of the shift-out state in a case in which the speed of the marine vessel 110 is the speed $V_2$.

In preferred embodiments of the present invention, when the speed change operation is performed in the intermittent operation mode, the controller 13 (see FIG. 3) controls the display 12 to display the changed speed of the marine vessel 110, and performs the adjustment shift-out start control. Specifically, as shown in FIG. 5, the controller 13 displays the speed of the marine vessel 110 on the display 12 substantially concurrently with adjusting the ratio between the duration $T_{10}$ (see FIG. 8) of the shift-in state and the duration $T_{20}$ (see FIG. 8) of the shift-out state.

According to the various preferred embodiments of the present invention described above, the following advantageous effects are achieved.

According to a preferred embodiment of the present invention, the controller 13 is configured or programmed to perform the shift-out start control to control the shift actuator 27 so as to immediately start the intermittent operation mode from the shift-out state when the intermittent operation switching control is performed to switch the normal operation mode to the intermittent operation mode based on the user's operation. Accordingly, after the normal operation mode is switched to the intermittent operation mode, the intermittent operation mode is started from the shift-out state. That is, unlike a case in which the intermittent operation mode is started from the shift-in state, the marine vessel 110 is immediately changed to a state in which the marine vessel 110 is navigated at a speed lower than that in the normal operation mode after the normal operation mode is switched to the intermittent operation mode. Consequently, responsiveness to switching from a state in which the shift-in state continues to a state in which the marine vessel 110 is navigated at a speed lower than that in the state in which the shift-in state continues is improved. That is, the possibility that the user who has performed the operation to change the speed of the marine vessel 110 feels that the timing of changing the speed of the marine vessel 110 is delayed is significantly reduced or prevented.

According to a preferred embodiment of the present invention, the controller 13 is configured or programmed to switch the shift-in state to the shift-out state at the predetermined timing corresponding to the predetermined period T in the intermittent operation mode, and perform the shift-out start control by shifting the predetermined timing when the intermittent operation switching control is performed. Accordingly, regardless of the timing at which the intermittent operation switching control is performed, the shift-out start control is performed when the intermittent operation switching control is performed.

According to a preferred embodiment of the present invention, the controller 13 is configured or programmed to perform the shift-out start control by resetting the timer 13*a* set to the predetermined period T and shifting the predetermined timing when the intermittent operation switching control is performed. Accordingly, the timer 13*a* is reset to easily shift the predetermined timing in order to perform the shift-out start control when the intermittent operation switching control is performed.

According to a preferred embodiment of the present invention, the marine vessel maneuvering system 100 includes the remote control lever 11 to adjust the speed of the marine vessel 110. Furthermore, the controller 13 is configured or programmed to perform the shift-out start control when the user performs the operation on the remote control lever 11 to reduce the speed of the marine vessel 110 to be lower than the predetermined speed $V_{EX}$. Accordingly, after the normal operation mode is switched to the intermittent operation mode based on the user's operation to reduce the speed of the marine vessel 110 to be lower than the predetermined speed $V_{EX}$, the marine vessel 110 is immediately changed to a state in which the marine vessel 110 is navigated at a speed lower than that in the normal operation mode.

According to a preferred embodiment of the present invention, the controller 13 is configured or programmed to perform the shift-out start control at the ratio between the duration $T_{10}$ of the shift-in state and the duration $T_{20}$ of the shift-out state according to the speed of the marine vessel 110 when the user performs the operation on the remote control lever 11 to reduce the speed of the marine vessel 110 to be lower than the predetermined speed $V_{EX}$. Accordingly, after the normal operation mode is switched to the intermittent operation mode, the marine vessel 110 is immediately changed to a state in which the marine vessel 110 is navigated at a speed lower than that in the normal operation mode and a speed according to the user's operation to change the speed of the marine vessel 110.

According to a preferred embodiment of the present invention, the controller 13 is configured or programmed to perform the shift-out start control when the intermittent operation switching control is performed in the automatic navigation mode in which navigation of the marine vessel 110 is automatically controlled. Accordingly, when the marine vessel 110 is automatically navigated, the responsiveness to switching from a state in which the shift-in state continues to a state in which the marine vessel 110 is navigated at a speed lower than that in the state in which the shift-in state continues is improved.

According to a preferred embodiment of the present invention, the marine vessel maneuvering system 100 includes the display 12 to display whether or not the marine vessel maneuvering system 100 is in the intermittent operation mode. Furthermore, the controller 13 is configured or programmed to control the display 12 to display that the marine vessel maneuvering system 100 is in the intermittent operation mode and perform the shift-out start control when the intermittent operation switching control is performed. Accordingly, the user visually recognizes that the marine vessel maneuvering system 100 is in the intermittent operation mode (the state in which the marine vessel 110 is navigated at a speed lower than that in the state in which the shift-in state continues) without feeling a time lag, while the responsiveness to switching from a state in which the shift-in state continues to a state in which the marine vessel 110 is navigated at a speed lower than that in the state in which the shift-in state continues is improved.

According to a preferred embodiment of the present invention, the controller 13 is configured or programmed to perform the shift-out start control when the intermittent operation switching control is performed when the marine vessel 110 is navigated either forward or rearward. Accordingly, when the marine vessel 110 is moving forward or rearward, the responsiveness to switching from a state in which the shift-in state continues to a state in which the marine vessel 110 is navigated at a speed lower than that in the state in which the shift-in state continues is improved.

According to a preferred embodiment of the present invention, the controller 13 is configured or programmed to perform the adjustment shift-out start control to control the shift actuator 27 so as to immediately start the intermittent operation mode, in which the ratio between the duration $T_{10}$ of shift-in state and the duration $T_{20}$ of the shift-out state has been adjusted according to the speed of the marine vessel 110, from the shift-out state based on the user's operation when the user performs the speed change operation to change the speed of the marine vessel 110 on the remote control lever 11 in the intermittent operation mode. Accordingly, the intermittent operation mode in which the ratio between the duration $T_{10}$ of the shift-in state and the duration $T_{20}$ of the shift-out state has been adjusted according to the speed of the marine vessel 110 is started from the shift-out state. That is, unlike a case in which the intermittent operation mode in which the ratio between the duration $T_{10}$ of the shift-in state and the duration $T_{20}$ of the shift-out state has been adjusted according to the speed of the marine vessel 110 is started from the shift-in state, the marine vessel 110 is immediately changed to a state in which the marine vessel 110 is navigated at a speed changed by the user. Consequently, responsiveness to switching a speed at which the marine vessel 110 is navigated is improved in a state in which the marine vessel 110 is navigated at a speed lower than that in the state in which the shift-in state continues.

According to a preferred embodiment of the present invention, the controller 13 is configured or programmed to switch the shift-in state to the shift-out state at the predetermined timing corresponding to the predetermined period T in the intermittent operation mode, and perform the adjustment shift-out start control when the user performs the speed change operation on the remote control lever 11 in the intermittent operation mode. Accordingly, in the intermittent operation mode, the adjustment shift-out start control is performed when the ratio between the duration $T_{10}$ of the shift-in state and the duration $T_{20}$ of the shift-out state is adjusted according to the speed of the marine vessel 110 regardless of the timing at which the speed change operation is performed on the remote control lever 11 by the user.

According to a preferred embodiment of the present invention, the controller 13 is configured or programmed to perform the adjustment shift-out start control by resetting the timer 13*a* set to the predetermined period T and shifting the predetermined timing when the user performs the speed change operation on the remote control lever 11 in the intermittent operation mode. Accordingly, the timer 13*a* is reset to easily shift the predetermined timing in order to perform the adjustment shift-out start control when the ratio between the duration $T_{10}$ of the shift-in state and the duration $T_{20}$ of the shift-out state is adjusted according to the speed of the marine vessel 110.

According to a preferred embodiment of the present invention, the controller 13 is configured or programmed to perform the adjustment shift-out start control when the user performs the speed change operation on the remote control lever 11 in the automatic navigation mode in which navigation of the marine vessel 110 is automatically controlled. Accordingly, the responsiveness to switching a speed at which the marine vessel 110 is navigated is improved in a state in which the marine vessel 110 is navigated at a speed lower than that in the state in which the shift-in state continues when the marine vessel 110 is automatically navigated.

According to a preferred embodiment of the present invention, the marine vessel maneuvering system 100 includes the display 12 to display the speed of the marine vessel 110. Furthermore, the controller 13 is configured or programmed to control the display 12 to display the changed speed of the marine vessel 110 and perform the adjustment shift-out start control when the speed change operation is performed in the intermittent operation mode. Accordingly, the user visually recognizes that the speed of the marine vessel 110 has been changed without feeling a time lag, while the responsiveness to switching a speed at which the marine vessel 110 is navigated is improved in a state in which the marine vessel 110 is navigated at a speed lower than that in the state in which the shift-in state continues.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the controller 13 preferably controls the display 12 to display the changed speed of the marine vessel 110 and performs the adjustment shift-out start control when the speed change operation is performed in the intermittent operation mode in preferred embodiments described above, the present invention is not restricted to this. In the present invention, the controller may alternatively perform the adjustment shift-out start control without controlling the display to display the changed speed of the marine vessel when the speed change operation is performed in the intermittent operation mode.

While the controller 13 preferably performs the adjustment shift-out start control when the user performs the speed change operation on the remote control lever 11 (operator) in the automatic navigation mode in which navigation of the marine vessel 110 is automatically controlled in preferred embodiments described above, the present invention is not restricted to this. In the present invention, the controller may alternatively perform the adjustment shift-out start control when the user performs the speed change operation on the operator in a manual navigation mode in which navigation of the marine vessel is manually controlled.

While the controller 13 preferably performs the adjustment shift-out start control by resetting the timer 13*a* set to the predetermined period T and shifting the predetermined timing when the user performs the speed change operation on the remote control lever 11 (operator) in the intermittent operation mode in preferred embodiments described above, the present invention is not restricted to this. In the present invention, the controller may alternatively perform the adjustment shift-out start control by shifting the predetermined timing using a method (interrupt control, for example) other than resetting the timer set to the predetermined period when the user performs the speed change operation on the operator in the intermittent operation mode.

While the controller 13 preferably performs the adjustment shift-out start control to control the shift actuator 27 so as to immediately start the intermittent operation mode, in which the ratio between the duration $T_{10}$ of shift-in state and the duration $T_{20}$ of the shift-out state has been adjusted according to the speed of the marine vessel 110, from the shift-out state based on the user's operation when the user performs the speed change operation to change the speed of the marine vessel 110 on the remote control lever 11 in the intermittent operation mode in preferred embodiments described above, the present invention is not restricted to this. In the present invention, the controller may not perform the adjustment shift-out start control (i.e., may alternatively start the intermittent operation mode in which the ratio between the duration of the shift-in state and the duration of the shift-out state has been adjusted according to the speed of the marine vessel from the shift-in state) when the user performs the speed change operation on the operator in the intermittent operation mode.

While the controller 13 preferably performs the shift-out start control when the intermittent operation switching control is performed when the marine vessel 110 is navigated either forward or rearward in preferred embodiments described above, the present invention is not restricted to this. In the present invention, the controller may alternatively perform the shift-out start control when the intermittent operation switching control is performed when the marine vessel is navigated other than forward and rearward.

While the controller 13 preferably controls the display 12 to display that the marine vessel maneuvering system 100 is in the intermittent operation mode and performs the shift-out start control when the intermittent operation switching control is performed in preferred embodiments described above, the present invention is not restricted to this. In the present invention, the controller may alternatively perform the shift-out start control without controlling the display to display that the marine vessel maneuvering system is in the intermittent operation mode when the intermittent operation switching control is performed.

While the controller 13 preferably performs the shift-out start control when the intermittent operation switching control is performed in the automatic navigation mode in which navigation of the marine vessel 110 is automatically controlled in preferred embodiments described above, the present invention is not restricted to this. In the present invention, the controller may alternatively perform the shift-out start control when the intermittent operation switching control is performed in the manual navigation mode in which navigation of the marine vessel is manually controlled.

While the controller 13 preferably performs the shift-out start control by resetting the timer 13*a* set to the predetermined period T and shifting the predetermined timing when the intermittent operation switching control is performed in preferred embodiments described above, the present invention is not restricted to this. In the present invention, the controller may alternatively perform the shift-out start control by shifting the predetermined timing using a method (interrupt control, for example) other than resetting the timer set to the predetermined period when the intermittent operation switching control is performed.

While the operator is preferably the remote control lever 11 in preferred embodiments described above, the present invention is not restricted to this. In the present invention, the operator may alternatively be an operator (such as a joystick or a touch panel) other than the remote control lever. When the operator is a touch panel, the touch panel may serve as the operator and the display.

While the controller 13 in the marine vessel maneuvering system 100 preferably performs a control to transition the manual navigation mode to the automatic navigation mode when the DOWN button 11*b* of the remote control lever 11 is pressed in the manual navigation mode in preferred embodiments described above, the present invention is not restricted to this. In the present invention, in the marine vessel maneuvering system, the controller may alternatively perform a control to transition the manual navigation mode to the automatic navigation mode when a portion (such as the UP button, a portion of the remote control lever other than the DOWN button and the UP button, or an operator other than the remote control lever) other than the DOWN button of the remote control lever is operated.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel maneuvering system comprising:

an engine;

a propulsive force generator to generate a propulsive force to propel a hull by a driving force from the engine;

a shift actuator to switch between a shift-in state in which the driving force is transmitted from the engine to the propulsive force generator and a shift-out state in which the driving force is not transmitted from the engine to the propulsive force generator; and a controller configured or programmed to control the shift actuator to switch between a normal operation mode in which the shift-in state continues and an intermittent operation mode in which the shift-in state and the shift-out state are repeated in a predetermined period of time based on a user's operation; wherein the controller is configured or programmed to perform a shift-out start control to control the shift actuator to immediately start the intermittent operation mode from the shift-out state when an intermittent operation switching control is performed to switch the normal operation mode to the intermittent operation mode based on the user's operation.

2. The marine vessel maneuvering system according to claim 1, wherein the controller is configured or programmed to switch the shift-in state to the shift-out state at a predetermined timing corresponding to the predetermined period of time in the intermittent operation mode, and perform the shift-out start control by shifting the predetermined timing when the intermittent operation switching control is performed.

3. The marine vessel maneuvering system according to claim 2, wherein the controller is configured or programmed to perform the shift-out start control by resetting a timer set to the predetermined period of time and shifting the predetermined timing when the intermittent operation switching control is performed.

4. The marine vessel maneuvering system according to claim 1, further comprising:

an operator to adjust a speed of a marine vessel; wherein the controller is configured or programmed to perform the shift-out start control when the user performs an operation on the operator to reduce the speed of the marine vessel to be lower than a predetermined speed.

5. The marine vessel maneuvering system according to claim 4, wherein the controller is configured or programmed to perform the shift-out start control at a ratio between a duration of the shift-in state and a duration of the shift-out state according to the speed of the marine vessel when the user performs the operation on the operator to reduce the speed of the marine vessel to be lower than the predetermined speed.

6. The marine vessel maneuvering system according to claim 1, wherein the controller is configured or programmed to perform the shift-out start control when the intermittent operation switching control is performed in an automatic navigation mode in which navigation of a marine vessel is automatically controlled.

7. The marine vessel maneuvering system according to claim 1, further comprising:

a display to display whether or not the marine vessel maneuvering system is in the intermittent operation mode; wherein the controller is configured or programmed to control the display to display that the marine vessel maneuvering system is in the intermittent operation mode and perform the shift-out start control when the intermittent operation switching control is performed.

8. The marine vessel maneuvering system according to claim 1, wherein the controller is configured or programmed to perform the shift-out start control when the intermittent operation switching control is performed when a marine vessel is navigated either forward or rearward.

9. The marine vessel maneuvering system according to claim 1, further comprising:

an operator to adjust a speed of a marine vessel; wherein the controller is configured or programmed to perform an adjustment shift-out start control to control the shift actuator to immediately start the intermittent operation mode, in which a ratio between a duration of the shift-in state and a duration of the shift-out state has been adjusted according to the speed of the marine vessel, from the shift-out state based on the user's operation when the user performs a speed change operation to change the speed of the marine vessel on the operator in the intermittent operation mode.

10. The marine vessel maneuvering system according to claim 9, wherein the controller is configured or programmed to switch the shift-in state to the shift-out state at a predetermined timing corresponding to the predetermined period of time in the intermittent operation mode, and perform the adjustment shift-out start control when the user performs the speed change operation on the operator in the intermittent operation mode.

11. The marine vessel maneuvering system according to claim 10, wherein the controller is configured or programmed to perform the adjustment shift-out start control by resetting a timer set to the predetermined period of time and shifting the predetermined timing when the user performs the speed change operation on the operator in the intermittent operation mode.

12. The marine vessel maneuvering system according to claim 9, wherein the controller is configured or programmed to perform the adjustment shift-out start control when the user performs the speed change operation on the operator in an automatic navigation mode in which navigation of the marine vessel is automatically controlled.

13. The marine vessel maneuvering system according to claim 9, further comprising:

a display to display the speed of the marine vessel; wherein the controller is configured or programmed to control the display to display a changed speed of the marine vessel and perform the adjustment shift-out start control when the user performs the speed change operation on the operator in the intermittent operation mode.

14. A marine vessel comprising:

a hull; and an outboard motor attached to the hull; wherein the outboard motor includes:

an engine;

a propulsive force generator to generate a propulsive force to propel the hull by a driving force from the engine;

a shift actuator to switch between a shift-in state in which the driving force is transmitted from the engine to the propulsive force generator and a shift-out state in which the driving force is not transmitted from the engine to the propulsive force generator; and a controller configured or programmed to control the shift actuator to switch between a normal operation mode in which the shift-in state continues and an intermittent operation mode in which the shift-in state and the shift-out state are repeated in a predetermined period of time based on a user's operation; and the controller is configured or programmed to perform a shift-out start control to control the shift actuator to immediately start the intermittent operation mode from the shift-out state when an intermittent operation switching control is performed to switch the normal operation mode to the intermittent operation mode based on the user's operation.

15. The marine vessel according to claim 14, wherein the controller is configured or programmed to switch the shift-in state to the shift-out state at a predetermined timing corresponding to the predetermined period of time in the intermittent operation mode, and perform the shift-out start control by shifting the predetermined timing when the intermittent operation switching control is performed.

16. The marine vessel according to claim 15, wherein the controller is configured or programmed to perform the shift-out start control by resetting a timer set to the predetermined period of time and shifting the predetermined timing when the intermittent operation switching control is performed.

17. The marine vessel according to claim 14, further comprising:

an operator to adjust a speed of the marine vessel; wherein the controller is configured or programmed to perform the shift-out start control when the user performs an operation on the operator to reduce the speed of the marine vessel to be lower than a predetermined speed.

18. The marine vessel according to claim 17, wherein the controller is configured or programmed to perform the shift-out start control at a ratio between a duration of the shift-in state and a duration of the shift-out state according to the speed of the marine vessel when the user performs the operation on the operator to reduce the speed of the marine vessel to be lower than the predetermined speed.

19. The marine vessel according to claim 14, wherein the controller is configured or programmed to perform the shift-out start control when the intermittent operation switching control is performed in an automatic navigation mode in which navigation of the marine vessel is automatically controlled.

20. The marine vessel according to claim 14, further comprising:

a display to display whether or not the marine vessel is in the intermittent operation mode; wherein the controller is configured or programmed to control the display to display that the marine vessel is in the intermittent operation mode and perform the shift-out start control when the intermittent operation switching control is performed.

* * * * *